US005596399A

United States Patent [19]

Dempsey et al.

[11] Patent Number: 5,596,399

[45] Date of Patent: Jan. 21, 1997

[54] COMPACT DOCUMENT MEASURING SYSTEM FOR ELECTRONIC DOCUMENT IMAGING

[75] Inventors: Neil J. Dempsey, Victor; Mark H. Buddendeck, Macedon, both of N.Y.

[73] Assignee: Xerox Corporation, Stamford, Conn.

[21] Appl. No.: 304,293

[22] Filed: Sep. 12, 1994

[51] Int. Cl.[6] ..... G03G 21/00

[52] U.S. Cl. ..... 399/45; 271/245; 271/265.02; 399/374

[58] Field of Search ..... 355/308, 309, 355/311, 316, 318, 317, 320, 23, 24; 271/245, 242, 256, 266, 188, 265.01, 265.02, 10.02, 10.03; 358/474, 505

[56] References Cited

U.S. PATENT DOCUMENTS

| | | | |
|---|---|---|---|
| 3,863,913 | 2/1975 | Hirafuji | 271/272 X |
| 3,882,744 | 5/1975 | McCarroll | 83/262 |
| 3,966,198 | 6/1976 | Komada et al. | 271/272 X |
| 4,025,187 | 5/1977 | Taylor et al. | 271/245 X |
| 4,262,895 | 4/1981 | Wenthe, Jr. | 271/65 |
| 4,669,853 | 6/1987 | Sosinski et al. | 355/309 |
| 4,745,438 | 5/1988 | Acquaviva et al. | 355/309 X |
| 4,905,052 | 2/1990 | Cassano et al. | 355/312 |
| 5,221,976 | 6/1993 | Dash et al. | 358/486 |
| 5,237,379 | 8/1993 | Sklut et al. | 355/311 |
| 5,294,965 | 3/1994 | May | 355/309 X |
| 5,333,852 | 8/1994 | Milillo et al. | 271/171 |
| 5,339,139 | 8/1994 | Fullerton et al. | 355/215 |
| 5,430,536 | 7/1995 | Fullerton et al. | 355/308 X |

OTHER PUBLICATIONS

Xerox Disclosure Journal, vol. 13, No. 3, May/Jun. 1988, pp. 119–121, Bruce, Jr. & Wiggins, "Drive and Timing Strategy For a CVT Image Input Terminal With Automatic Document Feeding".

IBM Technical Disclosure Bulletin vol. 17, No. 9, Feb. 1975 pp. 2690,2690A "Copy Sheet Size Selection" J.L. Bacon.

*Primary Examiner*—Shuk Yin Lee

[57] ABSTRACT

In a document handling system for feeding document sheets of varying dimensions to be imaged at an imaging station through a document feeding path from a document input tray, a system for automatically determining the dimension of the document sheet being fed in its feeding direction before it is imaged, yet also providing a compact document handling system with a short document feeding path, with a sheet buckling system including a sheet buckling chamber between the document input tray and the imaging station, and feeding the trailing portion of the document sheet faster than the leading portion to substantially buckle the intermediate portion out of the document feeding path so that the distance between the trailing and leading ends of the buckled document sheet along the document feeding path is substantially reduced, and so that the trailing end of the buckled document sheet normally passes and actuates a first sheet edge sensor before the sheet reaches a second sheet edge sensor upstream of the imaging station, to provide a timing signal usable for calculating the dimension of the document sheet even for document sheets longer than the document feeding path. The calculated dimension of the document sheet may be used to automatically select a copy sheet size onto which the image of the document sheet is to be printed and/or an imaging speed reduction for increased digital resolution.

12 Claims, 3 Drawing Sheets

COMPACT DOCUMENT MEASURING SYSTEM FOR ELECTRONIC DOCUMENT IMAGING

This system desirably allows the document dimension in the feeding direction to be sensed before it is imaged without requiring a long document path in the document handler. There is disclosed in the embodiment herein a very compact document handler having a desirably very short document feeding path for feeding and imaging sets of document sheets.

This disclosed embodiment is particularly advantageous for automatically feeding a set of document sheets to be electronically imaged from one or both sides in a digital copier, scanner, and/or facsimile machine in serial order with a very compact and low cost but reliable document feeding apparatus.

Correctly estimating a document sheet dimension in the feeding direction in advance of imaging that document is desirable for reasons such as selectively slowing the document imaging rate for digitizing the image with higher resolution for a selected image magnification, or preventing use of a simplex or duplex document path by documents exceeding the path length or capacity. Image magnification selection may be used for or in conjunction with different copy size selections, and one or both of said selections may desirably be automatic.

More specifically, there is disclosed in the specific exemplary embodiment herein in a document handling system for sequentially feeding document sheets of varying different standard dimensions to be imaged at an imaging station in a feeding direction through a document feeding path from the sheet output of a document input tray to said imaging station, with a document feeding system of known document sheet feeding velocities, the improvement for automatically determining the dimension of a document sheet being fed in its feeding direction from its leading end to its trailing end before it is imaged, yet providing a compact document handling system with a short said document feeding path, wherein first and second document sheet edge sensors are provided in the document feeding path, respectively located adjacent the sheet output of said document input tray and upstream of said imaging station, and actuatable by movement therepast of said ends of said document sheet; and wherein said document handling system has a document feeding path from said document input tray to said imaging station which is shorter than said longest said standard dimensions document sheets to be fed therethrough, said document feeding path has a sheet buckling system including a sheet buckling chamber intermediate of said document input tray and said imaging station, said sheet buckling chamber substantially extending normally from said document feeding path, said sheet buckling system providing for said feeding of the trailing end portion of a document sheet faster than the leading portion of a document sheet to substantially buckle the intermediate portion of said document sheet out of said document feeding path into said sheet buckling chamber so that said distance between said trailing and leading ends of the buckled document sheet along the document feeding path is substantially reduced, and so that said trailing end of said buckled document sheet along said document feeding path normally passes and actuates said first document sheet edge sensor in said document feeding path adjacent said sheet output of said document input tray before said leading end of said buckled document sheet in the document feeding path reaches and actuates said second document sheet edge sensor upstream of said imaging station, to provide a timing signal usable for calculating the dimension of the document sheet being fed from said known document sheet feeding velocity of said document feeding system, even for document sheets longer than said document feeding path.

Further disclosed features of the exemplary embodiment herein include, individually or in combination, those wherein the document sheet is buckled at said sheet buckling chamber to measure its length until its trailing end passes said first document sheet edge sensor, and/or wherein said sheet buckling system includes a system for temporarily stopping said movement of said leading end portion of said document sheet while said same document sheet continues to be fed into said document feeding path by said document feeding system past said first document sheet edge sensor at a said known document sheet feeding velocity; and/or in which said calculated dimension of said document sheet is for more rapidly automatically selecting a copy sheet size onto which the image of said document sheet is to be printed; and/or in which said timing signal proportional to said dimension of said document sheet is connected for more rapidly automatically selecting a copy sheet size onto which the image of said document sheet is to be printed and for selecting a reduction or magnification of said document image to fit the selected copy sheet; and/or in which said document handling system has a duplexing path for duplex document imaging, and wherein said timing signal provides a signal preventing use of said duplexing path for document sheets exceeding a preset length; and/or wherein said sheet buckling system for buckling a document sheet is not actuated if said document sheet dimension is sufficiently short that said trailing end of the document sheet in said document feeding path passes and actuates said first document sheet edge sensor before said leading end of said document sheet in the document feeding path reaches and actuates said second document sheet edge sensor; and/or wherein the operation of said sheet buckling system is terminated if said trailing end of the document sheet in the document feeding path does not pass and actuate said first document sheet edge sensor within a preset time period of feeding of the buckled document sheet corresponding to a maximum allowable buckling of said intermediate portion of said document sheet out of said document feeding path into said sheet buckling chamber; and/or further including a lateral document sheet dimension sensing system in said input tray; and/or wherein at least a third document sensor is provided in said document input tray to detect in said document input tray large document sheets with dimensions exceeding the capacity of the sheet buckling system sheet buckling chamber before they are fed; and/or wherein said document feeding path is U-shaped; and/or wherein said lateral document sheet dimension sensing system in said input tray comprises resetably spaced apart document sheet side guides.

By way of background, automatic copy sheet size selection based on document dimensions, and/or manually and/or automatically selected image reduction or magnification, is well known, e.g., IBM TDB Vol. 17, No. 9, February, 1975, p. 2690–2690A; or "auto-fit" patents discussed, for example, in Col. 4 of Xerox Corporation U.S. Pat. No. 4,745,438, issued May 17, 1988 to T. Acquaviva, et al; and U.S. Pat. No. 5,237,379 to R. L. Sklut et al, issued Aug. 17, 1993. These, and other patents cited hereinbelow, such as Xerox Corp. U.S. Pat. No. 5,333,852 and art cited therein, have various sheet size measurement systems. Electronic digital image scaling is taught, for example, in the below-cited U.S. Pat. No. 5,221,976, and cited art.

There is also, by way of background, various art on copy sheet or document sheet feeders or feeding in which the sheets are slightly buckled for other reasons in other applications, especially for sheet registration deskewing, or inverting, e.g. Xerox Corporation U.S. Pat. Nos. 3,882,744; 4,262,895; 4,669,853; and 4,905,052; and the below-cited 5,339,139. A sheet buckle formed ahead of a CVT (constant velocity transport) nip for the RIS is also disclosed in Xerox Corporation U.S. Pat. No. 4,451,030 by D. Teeter, et al.

For further details of an exemplary compact document handler in which the present system may be employed, like the embodiment here, reference is made to commonly assigned U.S. Pat. No. 5,339,139. Especially noted is its description of document size detection and CVT velocity change for image enlargement, and other art cited therein.

Further by way of background, it is known that combined facsimile and/or digital scanning for copying or network printing or electronic image storage (and even conventional light lens alternative copying) can be provided in a single unit, which may be encompassed by the term "printer". They are known as "multifunction", "multimode" or "combo" machines. E.g., Xerox Corporation U.S. Pat. No. 3,597,071 issued Jul. 27, 1971, on a "Diverse-Input System"; U.S. Pat. No. 4,947,345 issued Aug. 7, 1990 to Paradise, et al.; and Fuji Xerox Co. Ltd. U.S. Pat. No. 5,038,218, issued Aug. 6, 1991 to Matsumoto.

By way of general background, as scanners, printers, copiers and/or plural-mode integral such devices or systems increase in speed, and become more automatic, it is increasingly important to provide higher speed yet more reliable and more automatic handling and control of the document sheets being imaged and/or copied, i.e., the document input. It is desirable to reliably feed and register document sheets sequentially, which may present a variety or mixture of sizes, types, weights, thickness, materials, conditions and susceptibility to damage. "Originals" are often previous copies.

It is known in general that document handlers may be operated and controlled with various known controllers and various document positional sensors. It is now well known to be preferable to program and execute such control functions and logic with conventional software instructions for conventional microprocessors. Such software will vary depending on the particular function and the particular software system and the particular microprocessor or microcomputer system being utilized, but will be available to or readily programmable by those skilled in the applicable arts without undue experimentation from either verbal functional descriptions, such as those provided herein, and prior knowledge of those functions which are conventional, together with general knowledge in the software and computer arts. See, e.g., *In re Hayes Microcomputer Products Inc. Patent Litigation* (Fed. Cir. 1992); and *In re Alappat*, (Fed. Cir. 1994). Controls may alternatively be provided utilizing various other known or suitable hard-wired logic or switching systems.

In the description herein the term "document" or "sheet" refers to a usually flimsy sheet of paper, plastic, or other such conventional individual image substrate, and not to microfilm or electronic images which are generally much easier to manipulate. The "document" is the sheet (original or previous copy) being imaged. A "simplex" document (or copy sheet) is one having its image and page number on only one side or face of the sheet, whereas a "duplex" document (or copy sheet) has "pages", and normally images, on both sides, i.e., each duplex document is considered to have two opposing sides, faces, or "pages" even though no physical page number may be present.

As to specific hardware components of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the examples below, as well as the claims. Thus, the present invention will be better understood from this description, including the drawing figures (approximately to scale) wherein:

Figure 1:
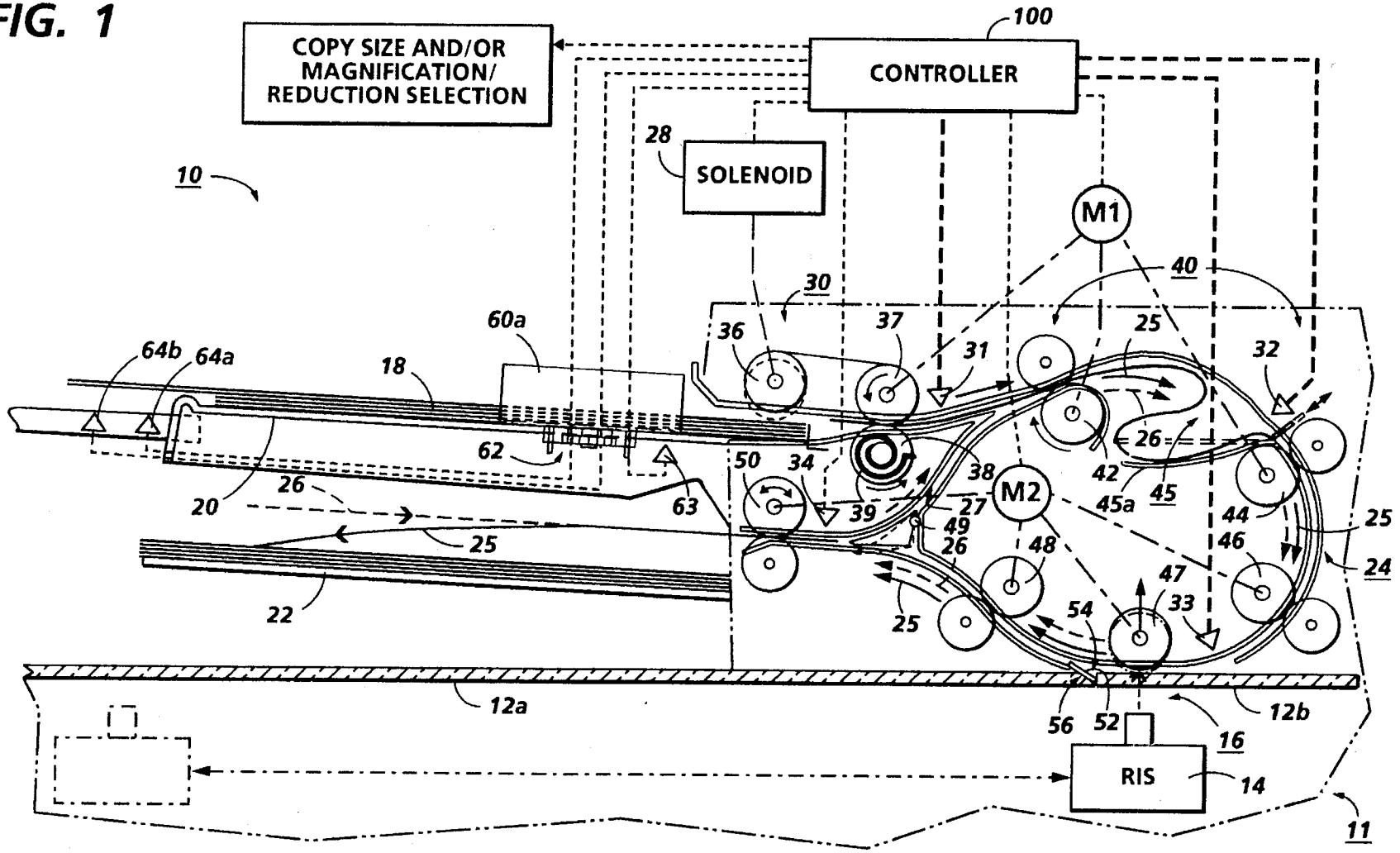
FIG. 1 is a partially schematic front view of one embodiment of an exemplary compact document handling system for electronically scanning moving documents incorporating the subject document buckling measuring system.

Describing now in further detail the exemplary embodiments with reference to the Figures, there is shown an exemplary document handler 10 providing the advantageous features noted above for an electronic copier and/or scanner. The exemplary document handling system 10 disclosed here includes a desirable small loop document path. It also provides "immediate" type duplex document inversion with the duplex sheet inverter chute path located over the top of the stack in the return or exit tray and under the input tray. This highly compact and lightweight document handler 10 may be a part of an optional or add-on top module 11 of a convertible digital copier/scanner unit (not fully shown). A platen 12 is provided with a large platen portion 12*a*, which may be scanned by a rastor input scanner or RIS 14, also part of the module 11. The exemplary RIS 14 here may be, e.g., a diode type full width array of a conventional type for high resolution, scanning closely under the platen. The entire scanner or input module 11, including the platen 12 and the RIS 14 desirably may be a removable top module so that the underlying processor or printer unit may alternatively be used as a stand alone or remote digital printer for remote electronic input. With the top module 11, including the document handler 10, mounted on the digital printer unit, the integrated unit provides a fully integrated convenience copier which even a casual operator may use simply by placing documents 18 in a document input tray 20 and automatically copying them at an imaging station 16 as if this were a normal light lens copier rather than a digital copier. Alternatively, the same document input at imaging station 16 (or platen portion 12*a*) provided here may also be easily used for facsimile transmissions. In that case the documents 18 will be similarly electronic imaged by RIS 14, but then transmitted over telephone lines or any other communications media, with or without electronic storage or buffering. Only the relevant portions of the digital copier top module 11 and its document handler 10 need be illustrated here since the digital printer or copy processor on which it may be mounted may be any of various known, conventional, or new electronic printer units, which do not per se form part of this invention, and therefore need not be described.

The same RIS 14 in this example may be utilized for scanning documents manually placed on the platen portion 12*a* as well as documents which are automatically fed to be imaged on platen portion 12*b* by the document handler 10. This is provided here by a two part platen 12 comprising a full size scanning platen portion 12*a* and a narrow slit scanning portion 12*b*. As may be seen, these two platen portions 12*a* and 12*b* are preferably closely adjacent one another and in the same plane and utilize the same frame mounting and/or alignment system. The two document trays 20, 22 may thus also primarily overlay the platen portion 12*a* rather than extend the machine footprint.

In the disclosed CVT system, including a driven over-platen roller 47, all three document feeding rollers, 46, 47 and 48 may be commonly driven by the same motor, such as servo motor M2, at the same speed, while the document is being imaged. The pre and post platen document feeding roller surfaces 46, 48 may, if desired, be metallic drive rollers, grit blasted, for increased long term drive radius stability and velocity control as compared to conventional elastomer document feeding surfaces.

The document handler 10 feeds documents to be imaged at a constant velocity with this CVT system past a scanning or slit image station 16 which is at the slit scanning platen portion 12*b*, as shown. For this document handler 10 document imaging, the RIS 14 is "parked" at this imaging station 16.

Documents 18 may be loaded face up in normal order in the document input tray 20 of the document handler 10 when automatic document input is desired. The stack of documents is then sequentially fed from the input tray 20 through a short, highly compact, "U" shaped document path 24 for imaging at the imaging station 16, and then after one imaging the simplex documents are fed directly on to a document output tray 22 in which the documents are restacked face down. However, as will be described, there is a partial difference in the document paths provided for simplex documents as compared to duplex documents. This is illustrated here by solid arrows representing the simplex document path 25 and dashed line arrows representing the duplex path 26. Note, however, that both simplex and duplex documents are ejected and restacked in the same document output tray 22 here, in the same manner, after their copying is completed.

The document input tray 20 here is closely superimposed above the document output tray 22. That is, these two trays closely overlay one another to form a relatively enclosed space between the two trays. Yet, both trays are readily operator accessible. This space between the two trays 20 and 22 provides a protective and space saving inverter chute for duplex documents which are being inverted between the copying of their first and second sides.

Note that the U-shaped document path 24 contains a single natural inversion for turning each document sheet over once between its infeeding from input tray 20 and the imaging station 16. This is the only inversion in this document path 24. And there is no inversion in the duplex path 27 added portions. The document path 24 is like a "U" lying on its side, facing and connecting with the input tray 20 and output tray 22 at the upper and lower ends of the "U", and with the imaging station 16 on the bottom side of the "U". It may also be seen that the duplex document path 27 utilizes the same U-shaped document path 24 shared by both simplex and duplex documents, but additionally provides a short duplex documents return path from the output end of the U-shaped document path 24 back to the input of that path 24, as will be further described.

All of the document sheet feeding in the document path 24, including the duplex document path 27 portions, and the imaging station 16, are all provided in this example by only two drive motors, a first drive motor M1 and a second drive motor M2, respectively connected to the various document path sheet feeders as illustrated by the illustrated connecting dashed lines. Both of the drive motors M1 and M2, all solenoids and clutches, are controlled by a controller 100, which may be of the type known in the prior art previously noted above. Also connecting with the controller 100 in a conventional manner are sheet path sensors for detecting the lead and/or trail edge of document sheets being fed through the document path 24, 27 such as the illustrated sensors 31, 32, 33, and 34. Thus, these sheet path sensors provide signals to the controller as to the present document position, when the respective sensor is activated. Because the document sheet or a portion thereof is thus known to be in a particular feeding nip moving it at a known speed, its position and movement distance can be predicted in advance by simple timing in the controller 100 in a known manner.

A solenoid 28 is connected to that portion of an exemplary top sheet separator/feeder 30 which sequentially feeds the top sheet of the stack of documents loaded in the input tray 20 into the U shaped document path 24, and separates each fed sheet from the respective underlying sheets. The sheet separator/feeder 30 may be driven by the motor M1, as shown. A nudger roll 36 is lowered by solenoid 28 onto the top of the stack for feeding or advancing the top sheet or sheets 18 into a positive retard separating nip, comprising a driven first feed roll 37 and an undriven retard roll 38. The driven feed roll 37 rotates to feed the top-most sheet at that point in time downstream into the document path 24, while subsequent or underlying sheets are retarded by the frictional retard roll 38 forming a nip therewith. To prevent wear spots or the like on the retard roll 38, the roller 38 is allowed some limited rotational movement forward or downstream. However, this roller 38 downstream rotation is resisted by a connected return spring 39, which spring 39 is wound up by roller 38 downstream rotation due to the high friction between rollers 37 and 38 when they are directly engaged (with no sheets therebetween). Whenever two or more sheets are in the retard nip between the rolls 37 and 38, the wound-up return spring 39 force is strong enough to overcome the (lesser) friction between the plural sheets in the nip, to push back upstream the underlying sheets, providing improved separation as further explained in the above-cited references. Once the top sheet has been fully acquired and fed downstream past the adjacent sensor 31, the nudger 36 may be lifted to prevent inadvertent further feeding therewith of an underlying sheet, and prevent smearing of document images. The initial sheet input velocity is preferably faster than the normal CVT velocity in the main portion of the document path. That higher initial velocity enables the lead edge of the (next) document being inputted to catch up with (close or minimize the inter-document pitch or gap with) the trail edge of the previous document in the document path.

Once a top sheet has been separated and fed into the document path 24 as described above, it then enters the regular document path sheet drive system 40. This will be described here with reference to the driven rollers, although the mating and nip-defining idler rollers are also illustrated. As shown, these document path sheet drive rollers of this example comprise, in order: second or take-away rolls 42, registration rollers 44 substantially spaced downstream thereof, with an intermediate sheet deskew buckle chamber area 45 or 45' therebetween, then first CVT rolls 46, then an imaging station 16 with the platen overlying sheet holddown CVT roller 47, then third CVT rolls 48, and then (after passing a pivotal gate 49) reversible exit nip rolls 50 at the entrance to the output tray 22. Note that the latter sheet path drive rollers (46, 47, 48, and 50) are illustrated as all driven by the motor M2, which is preferably a servo motor for controlled driving of these rolls and particularly to provide the accurate constant velocity desired for imaging.

The illustrated imaging station CVT roller 47 may be gravity or spring loaded against the platen, and may also provide, or be associated with, an imaging background surface for appropriate image background for the document being imaged at that point. It provides the control of the document being imaged to maintain all of document within the depth of field and focus of the imaging system as the document passes through the imaging station, i.e., to maintain a uniform restricted (very narrow height) maximum spacing gap above the imaging plane at the platen upper surface, of, e.g., less than 0.5 mm.

Figure 3:
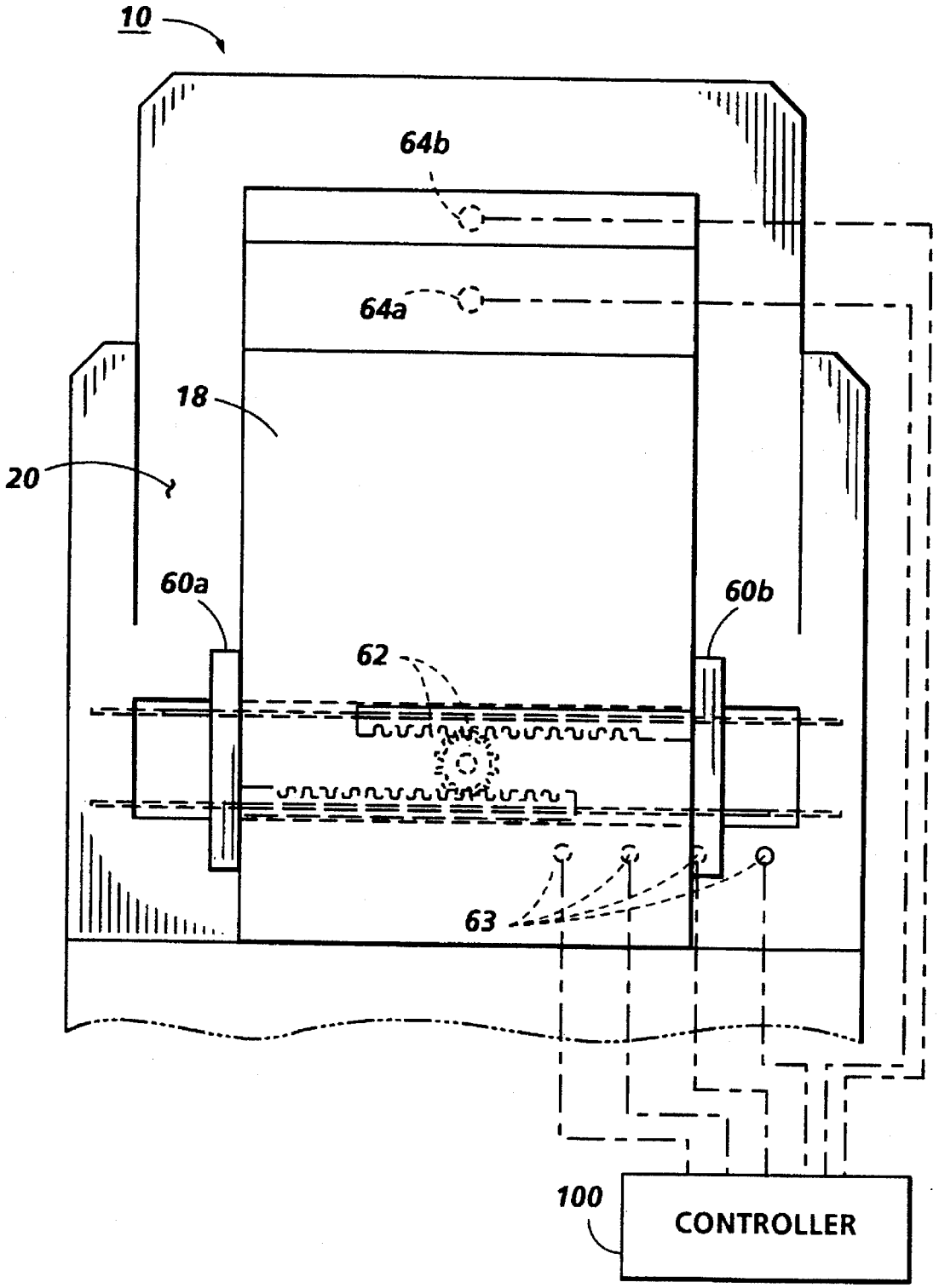
FIG. 3 is a top view of the input tray of FIG. 1 and/or FIG. 2, with an exemplary additional sheet size sensing system.

Referring particularly to FIG. 3, center registration and feeding of all documents can be conventionally provided by a well-known dual rack and pinion connection 62 of the opposing side-guides 60*a*, 60*b* of the document input tray 20, so that the side guides 60*a*, 60*b* automatically move together towards or away from one another by the same amount, so as to center the document stack irrespective of the size of the loaded documents. As per art cited below, known spaced plural sensor 63 or switches may be provided to detect the side guides 60*a*, 60*b* setting and thus may in a known manner indicate to controller 100 the lateral dimensions of the document sheet being stacked in tray 20. These in-tray sensors may be optional additional features, but can desirably provide combined input sheet size information with the other size information provided by the system herein, as will be further discussed.

Two other sensors or switches 64*a* and 64*b* are illustrated spaced out in the upstream end area of the tray 20, positioned to be respectively actuated by 13 or 14 inch or greater documents being loaded for short edge first feeding into tray 20. These two sensors 64*a*, 64*b* may desirably be eliminated by the present system, but are shown here to illustrate another known prior art DH tray feature.

Turning now to the subject system embodiment, as noted in the U.S. Pat. Nos. 5,339,139 and 5,221,976, for selectably enlarging images of certain size documents into enlarged copies on larger copy sheets, and/or enlarged partial images, without losing image resolution, it may be desirable to scan the document more finely by moving the document more slowly relative to the RIS 14. Thus, switching to a slower CVT document drive velocity may desirably be provided, e.g., one-half speed. Variable speed CVT electronic image scanning and electronic digital image magnification or reduction with scaling or resolution conversion is taught, for example, in Xerox Corp. U.S. Pat. No. 5,221,976 issued Jun. 22, 1993. (Running facsimile CVTs at different speeds for finer resolution, or to fit A4 size scanned originals into U.S. letter size copy sheets, is also known.) Depending on the selected enlargement and copy sheet size, or for other purposes, it can be desirable to know in advance of any imaging speed change the dimensions of the original document, especially the dimension in the CVT feeding and scanning direction. That is, to know the document size before any part of that document is imaged. If the scanning speed of the CVT is to be changed, it needs to be done before the lead edge of the document enters the imaging station 16.

However, the document handler 10 also desirably has a very short document path length, such that the trail edge of a large document will not have cleared the document input sensor 31 before the lead edge of that same large document enters the imaging station 16, or, more importantly, the lead edge detector 33 just upstream of the imaging station 16.

For normal, letter size documents, a document size detection system can be provided as follows: A normal (smaller size) document trail edge can actuate the sensor 31 adjacent the document input tray 20 before the (present, known) path velocity of the document handler will cause the lead edge of that document to actuate sensor 33, i.e., before the document lead edge reaches the imaging station 16. Thus, in this case of smaller documents, the first input sensor 31 in the document path adjacent the input tray can easily provide a document dimension signal which may be used in connection with printing controller information on the degree of desired image enlargement and/or selected and/or automatically selectable available copy sheet size to decide whether or not to change the CVT velocity, and/or by what extent, before that document reaches the imaging station.

If, however, the document dimension in the document feeding direction exceeds the document path distance (and thus feed time) from the document input sensor 31 to the imaging station input sensor 33, then another document dimension estimating or measuring system is needed before then if a CVT velocity change is to be provided based at least in part on the document size in the feeding direction.

One such system is to measure (sense) input tray side guide settings, and to use that measurement to estimate the other (orthogonal) dimension of the documents in a known manner from a look-up table stored in memory of standard sizes of sheets. Noted are Xerox Corporation U.S. Pat. Nos. 4,579,444, 4,745,438 (e.g. Col. 11), 3,689,143, and 4,351, 606 and 5,333,852; also U.S. Pat. No. 4,277,163 and 4,406, 537 of others. Also noted is a Xerox Disclosure Journal Publication Vol. 11, No. 2, p. 89, dated March/April 1986, by William A. Henry, II. However, that is not an infallible indicator of the orthogonal or feeding direction dimension of the document, which is the most critical dimension for the purposes noted here. For one thing, documents may be loaded either way into the tray 20, i.e., a width-wise or long edge first loading orientation or a length-wise or short edge first loading orientation. Feeding all sizes of documents widthwise is not desirable, since it requires a much wider document handier and RIS array.

To directly measure the document dimension in the feeding direction is difficult in the input tray without plural sensors such as 64*a*, 64*b*, etc. extending out into an extended area of the tray. Even these may not identify 17 inch or other very long docuemnts being loaded into the tray. (The side guide 60*a*, 60*b* setting for 11×17 inch documents is, of course, the same as for 8½×11 inch documents loaded width-wise into the tray.) The document scanner tray for the Eastman Kodak "1575" reportedly has a trail edge document length sensor and no back end guide wall. (Stack edge (and end) guide position settings sensors are also known for estimating the size of copy paper loaded into paper trays of a copier, such as U.S. Pat. Nos. 4,786,042 and 5,333,852.)

The system disclosed herein may be generally used in document handling systems for feeding documents from a stack of documents from a tray to an imaging station for imaging where information as to the size of the document being fed to the imaging station is needed before the start of said imaging of the document, where the input tray has an adjacent document edge sheet sensor, but where the distance between said document input sensor and said imaging station is such that the end of a large document will not have cleared the input sensor when the lead edge of that same document reaches said imaging station.

With the disclosed system, the overall document sheet path length of the document handler can be smaller than that of the largest standard size document to be fed and yet still measure the length of the document sheets before the lead edge of that document reaches the imaging station. This is accomplished here by buckling in a large buckle a substantial portion of the document sheet being fed, where required, i.e., where the sheet is larger than a short letter size sheet being fed widthwise or long edge first. As noted, a short sheet trail edge can clear the sensor 31 not long after its lead edge has passed the sensor 32. In the case of a longer document, where the sensor 31 is still occluded by the trailing edge portion of the document when the lead edge has passed the sensor 32 to partially enter the nip 44 (or if desired, also fed through the nip 46 up to the sensor 33) the sheet is substantially buckled here, as shown. This may be done by stopping the nip 44 (and nip 46 if the lead edge is extended into that nip) and continuing to feed the downstream or trailing area of the same document sheet by continued feeding of the nip 42 so that the remainder of the large document is substantially buckled into the buckling chamber area 45 (FIG. 1) or 45' (FIG. 2). As may be seen, in FIG. 1 the sheet is buckled in the buckling chamber 45 inwardly of the document handler into the interior of the normal document path. In FIG. 2 the document sheet is buckled outwardly and upwardly of the normal document path out of buckling chamber 45'.

Figure 2:
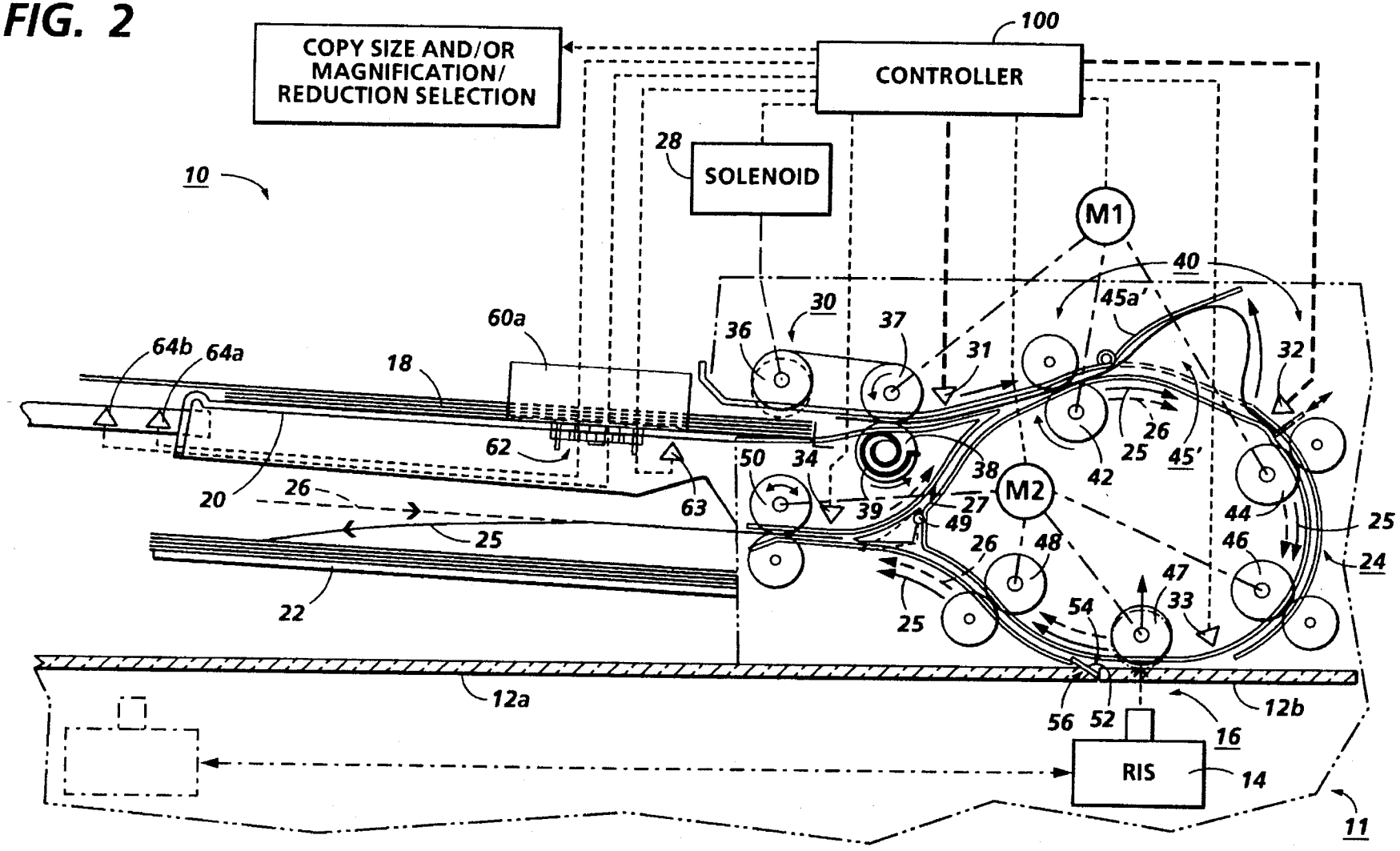
FIG. 2 is the document feeding system of FIG. 1 with an alternative embodiment of the document buckling system.

As is also illustrated in FIGS. 1 and 2, as an optional additional feature additional sheet buckling control may be provided, such as by the illustrated pivotable buckling control baffles 45*a* (FIG. 1) and/or 45'*a* (FIG. 2.). These baffles may be spring loaded to move with and help control the expanding buckle as the further portion of the document sheet continues to be fed into the buckle chamber by the rollers 42 while the lead edge of the document is being held, or greatly slowed down.

The buckling of a long document sheet continues until one of two events occurs. Either the trail edge of the document finally clears the sensor 31, or a preset feeding time, and therefore a preset allowed buckling distance, is exceeded. That is, if the trail edge of the document sheet clears the sensor 31 adjacent the sheet input tray before an excessive buckling is provided, then due to the known constant feeding velocity of the feed rollers 42 and the previous known feeding distance of the document since its lead edge reached the sensor 32 or 31, the length of the document in the feeding direction may be calculated in advance without having had to feed the document lead edge into the imaging station. Once the lead edge of the document clears the sensor 31, or the calculated maximum allowed buckle distance is exceeded, the lead edge of the area of the sheet which is being held in the nip 44 and/or 46 is restarted to feed the document past the sensor 33 and into the imaging station 16 for imaging. Since its length is thereby known in advance, there is time for the imaging velocity of the document to be reset to correspond to the selected magnification and/or copy size, as previously discussed in connection with the above-cited references thereon.

In the other situation, in which the length of the document being inputted turns out to be in excess of the amount of buckle allowed by the system, the very long document can then be fed rapidly through the imaging station and ejected while measuring its length without imaging it. Alternatively, the very long document can be fed and imaged at the normal (default) imaging speed. (Since it is a very long document, it is unlikely to require enlargement.)

As noted, with the present system, the end or document length sensors 64*a*, 64*b* in the tray 20 are not required. That can be desirable, since these sensors are an additional expense, and are located in positions where they may be accidentally occluded by the operator's hand, paper scraps or lint, or intermixed job document sizes.

As noted, the above-described feeding or process direction measurement of the document length can be combined with the above-described in-tray sensor system for additional or improved estimation. For example, if the side guides 60*a*, 60*b* are set 11 inches apart and an excessive length document is detected as described above, it may be presumed by the controller 100 to be an 11×17 inch document since that is the most likely combination of these two sensor measurement inputs. This would not be confused with an 11 inch wide document being fed widthwise with the present system (see below).

Note that the present system can assist in overcoming problems with intermixed jobs. That is, a set of documents placed in the input tray which are different size (mixed size) sheets. In-tray sensors alone can easily be fooled by such a mixed size set of originals, since the largest document of the document set in the tray will basically control the sensor's output.

An alternative for intermixed jobs is to require the operator to enter by a switch setting the fact that a mixed size job set is being loaded, and for the document handler to feed all of the documents in a "slew cycle" quickly through the document path to the output tray solely for the purpose of measuring the respective document dimensions in the document set before starting the imaging feed cycle, in those cases where it is necessary to know the document dimensions, i.e., where magnification has been selected or where the selected copy sheet size is different from the document sheet size. However, requiring a separate operator input for indicating mixed size originals is undesirable.

With the present system, letter (8½×11 inch) document sheets or A4 size may be intermixed with 8½×13 or 8½×14 inch (foolscap or legal size) documents and yet the length of these documents can be sensed to distinguish between them even though the path length from the input sensor 31 to the preimaging station sensor 33 is substantially less than 13 or 14 inches. The present system effectively compresses a substantial portion of the length of the document in the buckle chamber area so as not to require a normal document path of that length.

As noted, it is not necessary to accommodate 11×17 inch documents in the buckle chamber 45 or 45'. In this case the tray guides 60*a*, 60*b* and their associated respective sensors 63 will indicate the 11 inch width, and since 11 inch paper generally comes in only two orthogonal sizes, 8½× inch or 17 inch, the controller 100 may assume 17 inches in the process direction if sensor 31 remains blocked for any substantial time period after the time required to feed an 8½ inch document dimension past sensor 31. In the cases of setting the side guides 60*a*, 60*b* to an 8½ inch distance for the loaded documents, the logical or most possible document lengths in the feeding direction are 5.5 inches, 11 inches, 13 inches, or 14 inches. As described, the first two may be detected without buckling in the buckle chamber; and buckling as described here may be utilized for the 13 inch or 14 inch documents, to ensure measurement of their document length by this buckling system.

As indicated, the maximum length to be measured by this buckling system in comparison to the length of the document path will be affected by whether the document lead edge is to be stopped at a gate after sensor 32, or slightly into the roller 44 nip (as described below), or into the roller 46 nip (thereby accommodating an additional lead length of a document sheet which does not need to be buckled). Where the lead edge area of the document is held in rollers 44 until the trail edge clears sensor 31, the rollers 44 may be restarted with a higher velocity to make up for part of the time delay or pitch loss from the previous document imaged until the document lead edge reaches the roller nip 46, if desired.

In the FIG. 2 embodiment, the external covers or skins of the document handler unit (not shown) may be specially configured to allow a larger buckle to form thereunder.

Turning now to the exemplary output and duplex document handling system, a gate 49 is located at the downstream end of the U-shaped document path 24, just upstream of the reversible exit nip rolls 50 and at the entrance of the duplex document path 27. The gate 49 does not obstruct documents coming from the imaging station 16, irrespective of whether they are duplex or simplex documents. All documents here go directly past the imaging station 16 into the nip of the exit rolls 50. Simplex documents are fed on by these rolls 50 without any reversal thereof out into the exit tray 22 for restacking there in proper collated page order. These documents stack face down in 1 to N order, if the documents were fed face up in 1 to N order from the input tray 20 and were inverted once in the U-shaped document path 24.

However, for duplex documents which have been imaged on their first side and are yet to be imaged on their second side, as soon as the trail edge of the duplex document passes the sensor 34, the controller 100 directs the reversal of the exit rolls 50. The duplex document sheet at that point is extending substantially (for most of its length) out into the above-described inverter chute space between the trays 20 and 22. That duplex document sheet may now be rapidly reversed (25, 26) (feeding much faster than the CVT velocity) to be drawn back into the document handler toward the gate 49 by reversing rollers 50 at that point. The gate 49 is either solenoid or cam actuated or gravity loaded at this point into a position in which, as shown in phantom, the reversed duplex document is directed up into the duplex path 27. This duplex path 27 forms a return path of the duplex documents into the entrance of the U-shaped path 24, as previously noted.

While the document sheet is being driven forward by the CVT drive system of M2 driving lower rolls 46, 47 and 48 forward, the output roller 50 in that same path is desirably also driven forward by M2 at the same speed. However, when a duplex document is to be reversed, this may preferably be done by a clutch disconnecting the roller 50 shaft from M2, and then a simple reverse gear drive of the roller 50 shaft is electrically clutched in at that point to motor M1, while M1 continues to drive forward (downstream) the upper rollers 42 and 44 towards which the reversed document is fed by M1 reverse driven roller 50. To express it another way, for reversing, the clutch between roller 50 and M2 is disengaged and the clutch from M1 to the reverse gear drive for roller 50 is engaged. (Alternatively, a separate motor may be provided, if desired.) Note that for long duplex documents, this allows the trail end of the long duplex document to still be reverse fed out of roller 50 while the front end of that long document is already at the same time being fed forward through the CVT system for imaging by rollers 46, 47 and 48 driven forward by M2.

The combined duplex documents path 24, 27 provides a complete loop, as may be seen. This complete duplexing loop 24, 27 is quite small and compact. Desirably, it has dimensions only slightly larger than that of the longest document dimension to be fed therethrough. That is, this system is operative as long as the trail edge of the duplex document being inverted clears the sensor 34 before the lead edge of that same document sheet returns to the sensor 34 through the loop path 27, 24 after having its second side imaged at the imaging station 16. The duplex loop path length is preferably long enough for a U.S. standard 17 inch (approximately 43 cm.) duplex document to be fed short edge first. I.e., so that the head of the 17" or other longest document to be imaged doesn't hit the pre-exit sensor 34 until the tail of that long document clears that sensor 34.

This refeeding of duplex document sheets through the path 24 for second side imaging turns those document sheets over a second time. For proper collated output into the output tray 22, the duplex documents may be reinverted before restacking by being again fed back through the same path 27, 24 in the same manner, utilizing the same reversal of the exit rolls 50, but passing through without imaging, and then ejected (by not reversing the exit rolls 50). Thus, the duplex document is then ejected, properly oriented face down, into the output tray 22. Face down output for duplex documents is, of course, with the first or odd side page down, since this is a 1 to N system.

Referring to the duplex document scanning sequences available, the simplest sequencing algorithm is to process all documents in a simple 1 to N sequence, including "immediate duplex" sequencing of duplex originals. That is, side 2 of each duplex document may be scanned directly after side 1, followed by side 1 of the next fed document, etc. [Thus, one does not have to have 2 sheets in a document path at once.] The duplex document scanning sequence here may thus be side 1 of 1, skip, side 2 of 1, skip, side 1 of 2, skip, etc., relative to a normal inter-document gap for simplex documents feeding in this example of approximately 30 mm. Each "skip" is for inverting the document by reversal of the exit rolls 50 to feed that sheet back through the clockwise CVT path loop again; first for imaging its second side, and then for a non-imaging pass of the document sheet for re-inverting it again for proper output stacking. There is no need for deskew, constant velocity, or slowing down for CVT scan in this non-imaging pass. Thus, this third, non-imaging, document loop pass is desirably at a substantially higher (slew rate) velocity, to save time and increase overall duplex productivity. (However, the short path, simple drives and close document spacing may not allow that.) As noted, after the duplex sheet is fed through the document path for the third time, it returns back to the reversible exit rolls for the last time and is ejected to stack in collated order. However, it will be appreciated that there are other document sequencing alternatives.

Turning to another disclosed feature, there is also provided here a platen gap 54 by a beveled platen edge 56 on the main or full size platen portion **12*a* end facing 12*b*, as shown. As described in more detail in said U.S. Pat. No. 5,339,139, this provides a space or groove extending below the upper surface of the platen portion 12*b* into which a small baffle lip or catch 52 may be desirably attached to edge 56. The baffle lip 52 extends above and below the upper surface of the platen portion 12*b* over which documents are being fed for imaging at the imaging station 16. Thus, the lead edge of documents fed through the imaging station 16 over the platen 12*b*** upper surface are positively caught and deflected upwardly into the next feed nip.

While a known system of temporarily stalled document lead edge registration rolls 44 (temporarily stopped nip sheet deskew system) may be used, it will be appreciated that a conventional moving (removable) gate system may be used instead, with the gate positioned just ahead of that nip, as shown here with double arrow movement. The lead edge of the sheet may be fed up to and held against the gate fingers while they are in the sheet path, until the sheet is slightly buckled, and until the time for the sheet to be fed. Then the gate fingers may be lifted, e.g., by a solenoid or cam. In such a deskew system, if desired, the motor M2 may be used to continuously drive what is otherwise the stalled rolls 44 nip. Motor M1 would then only drive the sheet feeder 30 and the take-away nip 42.

However, for the system here, for improved buckle control and less critical lead edge capture force by nip 44 than if capture is attempted after a large buckle, the document lead edge is-preferably stopped (by stopping rollers 44) slightly after the document lead edge has been fed into and already captured by the nip 44.

While the embodiments disclosed herein are preferred, it will be appreciated from this teaching that various alternatives, modifications, variations or improvements therein may be made by those skilled in the art, which are intended to be encompassed by the following claims:

What is claimed is:

1. In a document handling system with a document feeding path for sequentially feeding document sheets of varying different standard dimensions, with leading and trailing ends, to be imaged at an imaging station in a feeding direction through said document feeding path from a document input troy sheet output to said imaging station, with a document feeding system of known document sheet feeding velocities, the improvement for automatically determining the dimension of a document sheet being fed in its feeding direction from its leading end to its trailing end before it is imaged, yet providing a compact document handling system with a short said imaged, yet providing a compact document handling system with a short said document feeding path, wherein first and second document sheet edge sensors are provided in the document feeding path, respectively located adjacent the sheet output of said document input tray and upstream of said imaging station, and actuatable by movement therepast of said leading and trailing ends of said document sheet; and wherein:

said document handling system document feeding path from said document input tray to said imaging station is shorter than the longest said standard dimensions document sheets to be fed therethrough, said document feeding path has a sheet buckling system including a sheet buckling chamber intermediate of said document input tray and said imaging station, said sheet buckling chamber substantially extending normally from said document feeding path, said sheet buckling system providing for said feeding of said trailing end of a document sheet faster than said leading end to substantially buckle the intermediate portion of said document sheet out of said document feeding path into said sheet buckling chamber so that said dimension between said trailing and leading ends of the buckled document sheet along the document feeding path is substantially reduced, and so that said trailing end of said buckled document sheet along said document feeding path normally passes and actuates said first document sheet edge sensor in said document feeding path adjacent said sheet output of said document input tray before said leading end of said buckled document sheet in the document feeding path reaches and actuates said second document sheet edge sensor upstream of said imaging station, to provide a timing signal usable for calculating the dimension of the document sheet being fed from said known document sheet feeding velocity of said document handling system, even for document sheets longer than said document feeding path.

2. The document handling system of claim 1, wherein the document sheet is buckled at said sheet buckling chamber to measure its length until its trailing end passes said first document sheet edge sensor.

3. The document handling system of claim 1, wherein said sheet buckling system includes a system for temporarily stopping said movement of said leading end of said document sheet while said same document sheet continues to be fed into said document feeding path by said document handling system past said first document sheet edge sensor.

4. Said document handling system of claim 1, in which said calculated dimension of said document sheet is utilized for automatically selecting a copy sheet size onto which the image of said document sheet is to be printed.

5. The document handling system of claim 1, in which said timing signal proportional to said dimension of said document sheet is connected to rapidly automatically select a copy sheet size, and for selecting a reduction or magnification of said imaged document to fit the selected copy sheet size.

6. The document handling system of claim 1, in which said document handling system has a duplexing path for duplex document imaging, and wherein said timing signal provides a signal preventing use of said duplexing path for document sheets exceeding a preset length.

7. The document handling system of claim 1, wherein said sheet buckling system for buckling a document sheet is not actuated if said document sheet dimension is sufficiently short that said trailing end of the document sheet in said document feeding path passes and actuates said first document sheet edge sensor before said leading end of said document sheet in the document feeding path reaches and actuates said second document sheet edge sensor.

8. The document handling system of claim 1, wherein the operation of said sheet buckling system is terminated if said trailing end of the document sheet in the document feeding path does not pass and actuate said first document sheet edge sensor within a preset time period of feeding of the buckled document sheet corresponding to a maximum allowable buckling of said intermediate portion of said document sheet out of said document feeding path into said sheet buckling chamber.

9. The document handling system of claim 1, further including a lateral document sheet dimension sensing system in said input tray.

10. The document handling system of claim 1, wherein an additional document sensor is provided in said document input tray to detect large document sheets with dimensions exceeding the capacity of said sheet buckling system.

11. The document handling system of claim 1, wherein said document feeding path is U-shaped.

12. The document handling system of claim 9, wherein said lateral document sheet dimension sensing system in said input tray comprises resetably spaced apart document sheet side guides.

* * * * *

UNITED STATES PATENT AND TRADEMARK OFFICE
CERTIFICATE OF CORRECTION

PATENT NO 5,596,399

DATED January 21, 1997

INVENTOR(S) Dempsey, et al

It is certified that error appears in the above-identified patent and that said Letters Patent is hereby corrected as shown below In claim 1, replace " troy " with --tray-- in line 6, and in lines 11-12, delete the partially duplicate phrase "yet providing a compact document handling system with a short said imaged"

Signed and Sealed this

Third Day of February, 1998

*Attest:*

Bruce Lehman

BRUCE LEHMAN

*Attesting Officer*

*Commissioner of Patents and Trademarks*